US009933239B2

(12) United States Patent
Johnson

(10) Patent No.: US 9,933,239 B2
(45) Date of Patent: Apr. 3, 2018

(54) ARCHERY FIELD TIP BULLET

(71) Applicant: Karl N. Johnson, Frederick, CO (US)

(72) Inventor: Karl N. Johnson, Frederick, CO (US)

( * ) Notice: Subject to any disclaimer, the term of this patent is extended or adjusted under 35 U.S.C. 154(b) by 0 days.

(21) Appl. No.: 14/297,205

(22) Filed: Jun. 5, 2014

(65) Prior Publication Data

US 2014/0364256 A1 Dec. 11, 2014

Related U.S. Application Data

(60) Provisional application No. 61/831,245, filed on Jun. 5, 2013.

(51) Int. Cl.
*F42B 6/08* (2006.01)
*F42B 10/24* (2006.01)

(52) U.S. Cl.
CPC ..... *F42B 6/08* (2013.01); *F42B 10/24* (2013.01); *Y10T 29/49826* (2015.01)

(58) Field of Classification Search
CPC ..... F42B 6/08
See application file for complete search history.

(56) References Cited

U.S. PATENT DOCUMENTS

| | | | | | |
|---|---|---|---|---|---|
| 1,307,419 | A * | 6/1919 | Rogers | 102/501 |
| 2,125,591 | A * | 8/1938 | Smith | 124/24.1 |
| 2,414,863 | A * | 1/1947 | Foster | 102/517 |
| 3,751,037 | A * | 8/1973 | Courneya | 473/586 |
| 4,063,511 | A * | 12/1977 | Bullard | 102/436 |
| 4,996,924 | A * | 3/1991 | McClain | 102/501 |
| 5,269,534 | A * | 12/1993 | Saunders et al. | 473/582 |
| 6,595,880 | B2 * | 7/2003 | Becker | 473/578 |
| 2006/0084535 | A1 * | 4/2006 | Kuhn | 473/583 |

* cited by examiner

*Primary Examiner* — John Ricci
(74) *Attorney, Agent, or Firm* — Marger Johnson

(57) ABSTRACT

An arrow tip comprising a bullet body tapering from a rear end to a tip end and at least two helical grooves formed within the bullet body from the tip end to the rear end. A stem is coupled to the rear end of the bullet body and has a threaded portion at a terminal end thereof configured to screw into an arrow shaft.

11 Claims, 2 Drawing Sheets

ARCHERY FIELD TIP BULLET

CROSS-REFERENCE TO RELATED PATENT APPLICATION

This application claims priority to U.S. Provisional Patent Application No. 61/831,245, filed Jun. 5, 2013, the disclosure of which is herein incorporated by reference.

BACKGROUND OF THE INVENTION

1. Field of the Invention

This invention relates generally to archery field tips and more particularly to such tips that include a rifled bullet tip.

2. Description of the Related Art

The standard archery arrow is a suitable length shaft with vanes or fletching affixed at the posterior end. When propelled by a bow, the arrow's flight is stabilized by virtue of the fletching's drag against air resistance. While this construction does achieve a relatively straight line of flight (except for the effect of gravity on the flight), it does so at the cost of energy loss in direct proportion to distance of flight as the air resistance is a substantially constant function of arrow flight speed.

If rotation can be imparted to the arrow, the arrow will be stabilized in a manner similar to a bullet shot from a rifled barrel firearm. Some attempts have been made to provide rotation to an arrow. U.S. Pat. No. 5,971,875 discloses a slot which drives against circumferentially arranged dimples. U.S. Pat. No. 6,478,700 discloses an arrow shaft with screw surfaces. These and other exiting technologies focuses on the shaft and fletching of the arrow and not the field tip itself.

The need exists, therefore, for field tip designs used on an arrow or crossbow that starts its spin faster off the string than a traditional field or target tip.

SUMMARY OF THE INVENTION

The inventive design for an arrow tip comprises a bullet body tapering from a rear end to a tip end and at least two helical grooves formed within the bullet body from the tip end to the rear end. A stem is coupled to the rear end of the bullet body and has a threaded portion at a terminal end thereof configured to screw into an arrow shaft.

The components of the invention are the tip, housing and thread housing. The tip is machined similar to that of a bullet as it leaves the barrel. The design allows the air/wind to grab the grooves and start the spin faster than traditional helping the arrow to straighten out and shoot more accurately.

My design allows the user the ability to shoot more accurately because of the increase spin in the arrow from the design in the tip. My design also allows the end use a tip that will help in the removal or pulling from the target. This is accomplished with the soften slop on the shaft end of the field tip.

The inventive method for forming a rifled arrow tip includes the steps of providing a bullet-shaped field archery field tip tapering from a rear end to a tip end and forming grooves in a surface of the field tip in a helical pattern from adjacent the rear end to adjacent the tip end. The stem is then affixed to a rear end of the bullet tip coaxially into an arrow shaft as by screwing via threaded portions.

The foregoing and other objects, features and advantages of the invention will become more readily apparent from the following detailed description of a preferred embodiment of the invention that proceeds with reference to the accompanying drawings.

DETAILED DESCRIPTION

Figure 1:
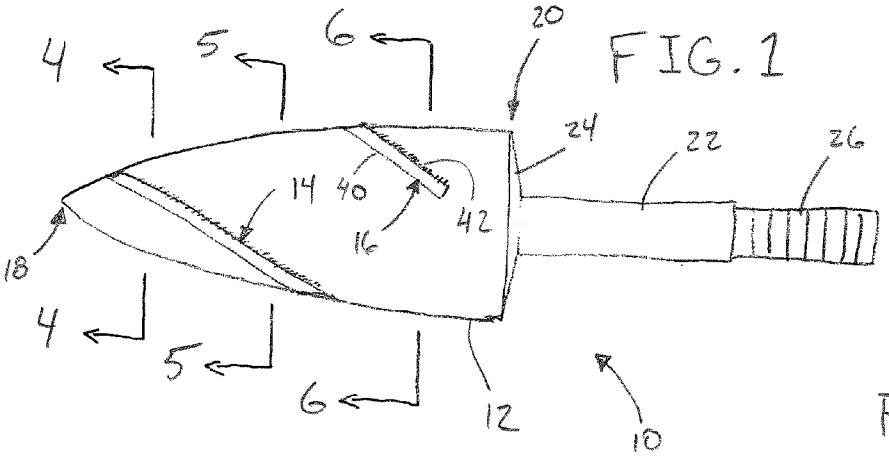
FIG. 1 is a side elevation view of an archery field tip bullet constructed according to a preferred embodiment of the invention.
Figure 8:
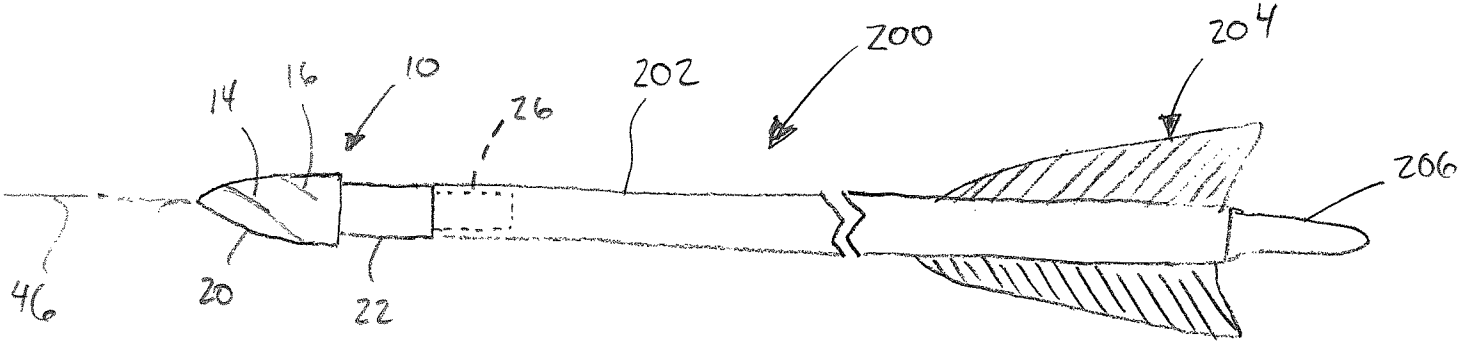
FIG. 8 is a side elevation view of the archery field tip bullet of FIG. 1 installed on an arrow.

FIG. 1 shows an archery field tip bullet 10 constructed according to a preferred embodiment of the invention. Bullet 10 includes a bullet body 12 having machined therein at least two helical grooves 14, 16 and running from adjacent a tip end 18 at the front of the bullet body 12 to the rear end 20. A stem 22 is coupled to a back edge 24 of the rear end 20, where the back edge 24 slopes forwardly from the stem 22 to the rear end 20 to form a slightly frusto-conical face. Stem 22 includes a threaded portion 26 at a terminal end thereof that is configured to screw into an arrow shaft, such as shown in FIG. 8.

The grooves 14, 16 are machined into the surface of bullet body 12 so as to have a helical curve around the bullet body. The grooves 14, 16 shown in FIG. 1 are formed with a right-hand or clockwise helical pattern about the bullet body so as to impart spin to the archery field tip bullet 10 in the opposite direction and thereby improve the stability of the projectile in flight and thereby improve its range and accuracy.

Figure 2:
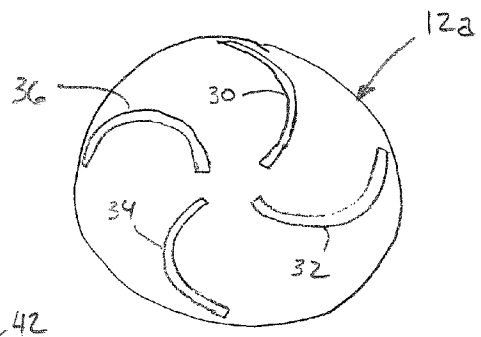
FIG. 2 is a front elevation view of the archery field tip bullet like FIG. 1 with the direction of grooves reversed to promote opposite rotation of the field tip than that of FIG. 1.

FIG. 2 shows a front elevation view of the archery field tip bullet, but showing four grooves 30, 32, 34, and 36 having a helical curve about the bullet body 12*a* in the opposite direction—e.g. left-hand or counterclockwise—so as to impart a counterclockwise rotation as seen from the archer's point of view.

Figure 3:
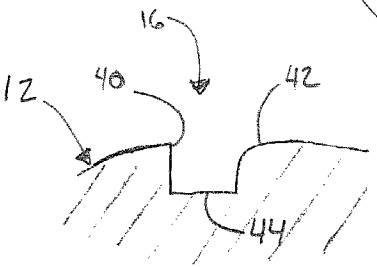
FIG. 3 is a section showing a magnified view of a groove formed in the archery field tip bullet of FIG. 1.

FIG. 3 illustrates a close-up section of helical groove 16. The helical grooves such as groove 16 each include a leading edge 40 formed on an inside curve of the helical groove and a trailing edge 42 on an outside curve of the helical groove, the trailing edge 42 having a softened or more-rounded edge as compared to the leading edge 40. The softened edge of the grooves on the shaft side of the tip provide for quicker start of rotation, and the softened back edge allows for easier and faster retrieval. This combined will provide an optimal experience for the user.

The helical grooves are machined or cast into the surface of bullet body 12 with a depth of between about fifteen and thirty thousands of an inch from a top edge, such as leading edge 40, and a bottom, such as bottom 44. The square groove such as shown in FIG. 3 is preferred, although it can be understood that the groove may be formed with a different shape such as V-groove without departing from the spirit of the invention.

Figure 4:
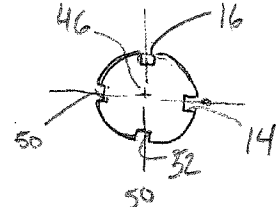
FIG. 4 is a side-section view of the archery field tip bullet of FIG. 1 taken along line 4-4.
Figure 5:
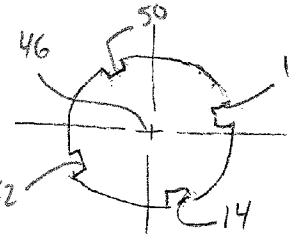
FIG. 5 is a side-section view of the archery field tip bullet of FIG. 1 taken along line 5-5.
Figure 6:
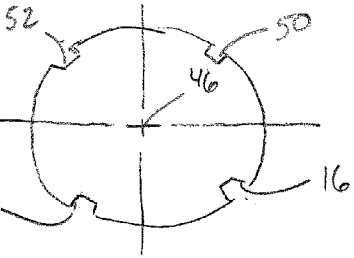
FIG. 6 is a side-section view of the archery field tip bullet of FIG. 1 taken along line 6-6.

FIGS. 4-6 show the location of the grooves along different points on the long axis 46 of the bullet body 12. That is, as one moves back from tip 18, the location of the grooves—such as grooves 14 and 16—slowly twist about the bullet body axis 46 in either a clockwise or counterclockwise direction depending upon the type of spin desired. The rate of curve or twist rate of the helical grooves is preferably between a 6:1 and 10:1 ratio, that is where the grooves make a full rotation about the bullet body every six inches or ten inches respectively, and most preferably about an 8:1 ratio. This could be based on the size, weight and amount of rotation desired. A shorter distance indicates a faster twist or higher spin rate. These lands are grooves can vary in number, depth, shape, direction of twist (e.g. either right or left), and twist rate. Archery field tip bullet 10 is formed with four grooves 14, 16, 50, and 52, although it is understood that more or fewer grooves can be included in the bullet body without departing from the spirit of the invention.

Figure 7:
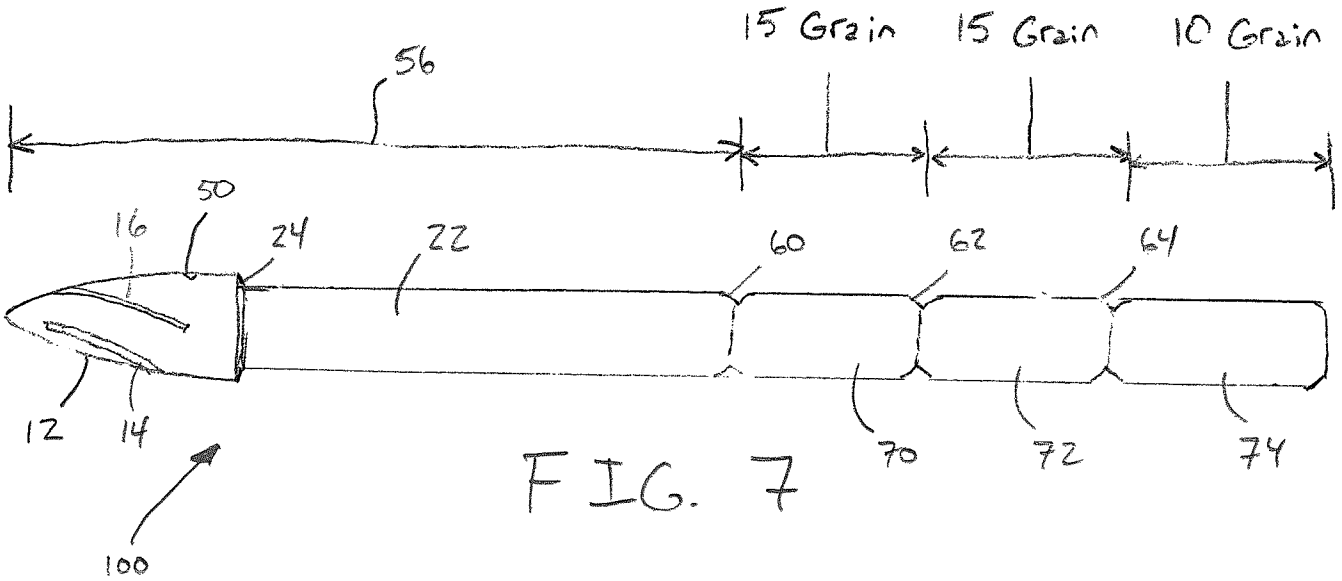
FIG. 7 is a side elevation view of an alternate embodiment of an archery field tip bullet formed with break-away points to adjust the weight of the resulting archery field tip bullet.

FIG. 7 illustrates an alternate embodiment of an archery field tip bullet 100 formed with break-away points to adjust the weight of the resulting archery field tip bullet. The bullet body 12 and stem 22 are sized and weighted to have a certain desired weight 56, for instance between 85 and 115 grain. Break-away points 60, 62, and 64 are formed along the length of the stem 22 so that certain predefined weighted portions 70, 72, 74 may be broken off and the shortened stem inserted within an arrow shaft. In a preferred embodiment, the break points are spaced evenly along a length of the stem 22, e.g. between about 5 and 15 grain increments along the length of the stem. The embodiment shown in FIG. 7 has the break points not spaced evenly so that the weighted break-off portion 74 has a different weight (e.g. 10 grain) than weighted break-off portions 70 and 72 (e.g. 15 grain).

FIG. 8 illustrates an assembled arrow 200 using the archery field tip bullet 10 of the present invention. The arrow 200 is assembled by first providing a bullet-shaped field archery field tip 10 that tapers from a rear end to a tip end of the bullet body 12. Grooves 14, 16 are formed in a surface of the field tip in e helical pattern from adjacent the rear end 20 to adjacent the tip end 18. The stem 22, affixed to a rear end of the bullet tip, is then coaxially screwed or otherwise inserted into a complementary portion of the shaft 202 of arrow 200. If the field tip includes weighted break-off portions 70, 72, 74 such as shown in FIG. 7, then a portion of the stem is removed along one of the break off points so that a predefined weighted portion is removed from the rifled arrow tip prior to screwing the stem 22 coaxially into the arrow shaft 202. To help remove the spurs and other undesired items from the machining and/or casting process of the field tip, the tip may be tumbled prior to screwing the stem 22 onto the arrow shaft 202. Tumbling also has the advantage of increasing the resulting velocity of the arrow using the field tip due to the smooth finish. To complete the arrow 200, fletching 204 is added at a rear portion of the shaft 202 and a nock 206 included at a terminal end of the shaft 202.

The overall structure of the invention includes the field tip, machined or cast grooves, housing and the threaded housing. The tip and housing (including threaded) are all one piece. The housing and diameter of the field tip will vary on the application from bow, crossbow and the application within those fields to achieve the desired outcome (i.e. the desired diameter and shape of field tip). The field tip shape can change on desired outcome as well.

The field tip will fit into the shaft of the arrow from a bow, crossbow etc. and thread into the arrow insert. Multiple options and combination of the field tip can be produced for the user to achieve the desired rotation of the arrow. Only one is draw.

The components of this invention are a tip, machined or cast grooves, housing, and threaded housing. The machined or cast grooves built into the field tip are critical parts of the design. The design is for quicker rotation of the arrow and easy pulling/removal of the arrow from the target to provide a better user experience. This invention will help to decrease the amount of time the arrow takes to reach maximum rotation before impacting the target and retrieval when pulling backwards.

The materials used form the field tip can vary on need and application. Various changes to the design can include rotational and retrieval features such as depth of groove, angle of groove, material of field trip, and angle or soften back edge on shaft side. Material options for the field tip can include titanium, carbon, aluminum, metal, graphite, and other machined, cast or molded materials. Mechanical features: varying thread count, field tip size, field tip shape, groove count, depth of groove, starting and stopping of the grooved feature. The length and shape of the point will vary in size depending on the weight of the point.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. An arrow tip comprising:

a bullet body tapering from a rear end to a tip end;

at least two helical grooves formed within the bullet body from the tip end to the rear end, wherein the helical grooves each include a leading edge formed on an inside curve of the helical groove and a trailing edge on the outside curve of the helical groove, the trailing edge having a softened edge as compared to the leading edge; and a stem coupled to the rear end of the bullet body and having a threaded portion at a terminal end thereof configured to screw into an arrow shaft.

2. The arrow tip of claim 1, further including a break point formed along the stem.

3. The arrow tip of claim 1, further including a plurality of break points spaced evenly along a length of the stem.

4. The arrow tip of claim 3, wherein the break points are spaced between 5 and 15 grain increments along the length of the stem.

5. The arrow tip of claim 1, wherein the rear end of the bullet body slopes forwardly from the stem to a back edge of the bullet body.

6. The arrow tip of claim 1, wherein the helical grooves curve about the bullet body at a ratio of between about 1:6 and 1:10.

7. The arrow tip of claim 6, wherein the helical grooves curve about the bullet body at a ratio of about 1:8.

8. The arrow tip of claim 1, wherein the helical grooves have a depth of between about 12 and 30 thousands of an inch.

9. A method for forming a rifled arrow tip, including the steps of:

providing a bullet-shaped field archery field tip tapering from a rear end to a tip end;

forming grooves in a surface of the field tip in a helical pattern from adjacent the rear end to adjacent the tip end wherein the helical grooves are formed with a leading edge on an inside curve of the helical groove and a trailing edge on the outside curve of the helical groove, the trailing edge formed with a softened edge as compared to the leading edge; and screwing a stem affixed to a rear end of the bullet tip coaxially into an arrow shaft.

10. The method of claim 9, further including the step of forming weighted break off points along a length of the stem and removing a portion of the stem along one of the break off points so that a predefined weighted portion is removed from the rifled arrow tip prior to screwing the stem coaxially into the arrow shaft.

11. The method of claim 9, further including tumbling the field tip prior to screwing the stem onto the arrow shaft.

* * * * *